US005667381A

United States Patent [19]

Young

[11] Patent Number: 5,667,381

[45] Date of Patent: Sep. 16, 1997

[54] TELESCOPIC ARM ASSEMBLY FOR THE SUPPORT OF DENTAL TOOLS

[75] Inventor: Barry S. Young, Tualatin, Oreg.

[73] Assignee: Dental Components, Inc., Newberg, Oreg.

[21] Appl. No.: 556,482

[22] Filed: Nov. 13, 1995

[51] Int. Cl.[6] ..... A61G 15/00

[52] U.S. Cl. ..... 433/79; 297/163

[58] Field of Search ..... 433/77, 78, 79; 297/163, 167, 168, 169, 191; 248/280.1, 281.1

[56] References Cited

U.S. PATENT DOCUMENTS

| | | | |
|---|---|---|---|
| D. 356,640 | 3/1995 | Nordstrom et al. | D24/176 |
| 531,257 | 12/1894 | Bond | 433/79 X |
| 2,258,126 | 10/1941 | Slutzky | 433/79 |
| 4,630,862 | 12/1986 | Watanabe | 297/167 |
| 4,883,316 | 11/1989 | Austin et al. | 297/191 |
| 5,176,423 | 1/1993 | Austin et al. | 297/191 |
| 5,281,136 | 1/1994 | Giannella et al. | 433/76 |

*Primary Examiner*—Nicholas D. Lucchesi
*Attorney, Agent, or Firm*—James D. Givnan, Jr.

[57] ABSTRACT

A telescopic arm assembly for use in conjunction with a dental chair unit and attachable to a post of the unit. A main arm defines a slot at its inner end to receive an arm support including a pivot pin about which the arm may move in an upright manner. A limit stop on the support controls arm movement. A secondary arm supports a tool holder at its outer end and is provided with pin-shaped followers at its inner end which ride along guides extending lengthwise of the main arm to prevent rotation of the secondary arm within the main arm.

4 Claims, 1 Drawing Sheet

TELESCOPIC ARM ASSEMBLY FOR THE SUPPORT OF DENTAL TOOLS

BACKGROUND OF THE INVENTION

The present invention pertains to equipment for supporting dental equipment in a highly accessible location adjacent a dental chair.

Dental chair assemblies include an array of components including equipment supporting arms some of which are independently movable to position the dental equipment supported for ready access in all chair positions. One such component is termed a dental assistant's arm on which the assistant's tools are carried. As such arms are in close proximity with the positionable dental chair it is important that the arm may swing upwardly when inadvertently displaced by the chair when the dental work has been completed and the chair positioned for patient egress.

One such arm is disclosed in U.S. Pat. No. Des. 356,640, wherein an arm pivots about a pivot pin attaching the arm to a support for arm movement about a pin horizontal axis. A segment of a second arm is shown projecting from a main arm. Pivotal movement of the main arm and an arm support member results in a pinch point occurring therebetween during arm movement.

SUMMARY OF THE PRESENT INVENTION

The present invention is embodied in an arm structure which is an accessory to a dental chair unit for the support of dental tools in a highly accessible position.

A main arm of the arm assembly is swingably supported at one of its ends for a range of travel. A secondary or telescopic arm is provided for rectilinear travel within the main arm with a guide and followers preventing rotational movement between the arms. The followers project from the secondary arm for sliding engagement with guides extending lengthwise of the main arm. Follower ends are oppositely disposed from the guide to prevent undesired rotation of the secondary arm. Limit stop means for the main arm are housed internally to preclude any risk of injury from an exposed pinch point.

Important objectives of the present arm assembly include the provision of a dental assistant's arm assembly which is free to swing without a pinching action occurring between arm assembly components; the provision of a dental arm assembly having a concealed pivot and limit stop means to avoid risk resulting from an exposed pinch point; the provision of a dental arm assembly of a telescopic nature wherein independent rotational movement is prevented between the arm members by radially directed followers on one arm member terminating in oppositely disposed fashion from a guide extending lengthwise of the arm assembly.

DETAILED DESCRIPTION OF THE PREFERRED EMBODIMENTS

Figures 1, 2, 3, 4, 5:
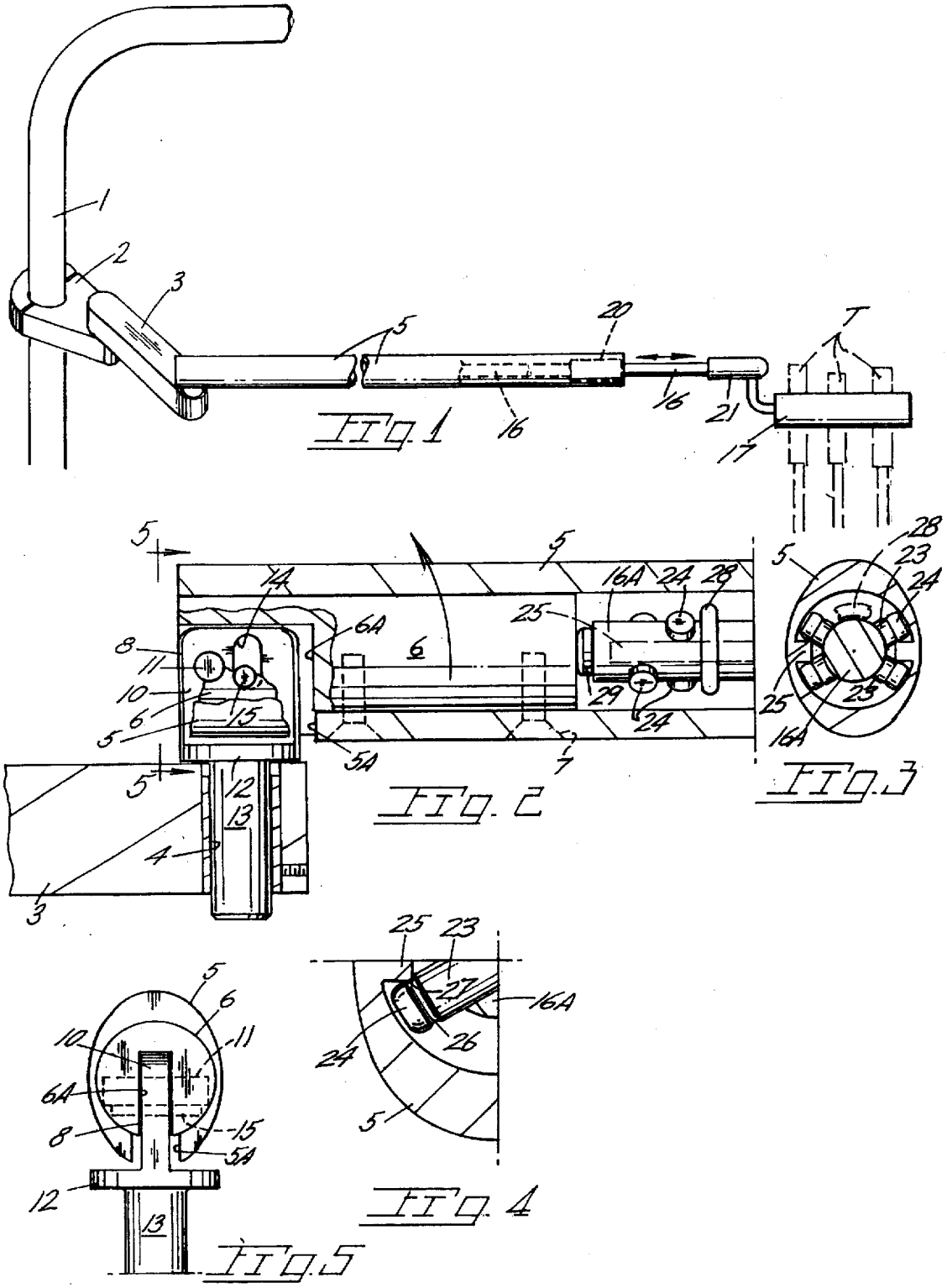
FIG. 1 is a perspective view of the present arm assembly operatively disposed.
FIG. 2 is a fragmentary sectional view of the proximal end of the arm assembly.
FIG. 3 is an end view of the right hand end of FIG. 2.
FIG. 4 is an enlarged fragmentary view of FIG. 3.
FIG. 5 is an end elevational view taken along line 5—5 of FIG. 2

With continuing attention to the drawings, the reference numeral 1 indicates a post of a dental unit including a chair and various dental accessories not shown.

In place on post 1 is a bracket 2 which carries a swingable support 3 which may move about an upright axis at its supported end. Support 3 is provided with a bushing 4 and an adjustable set screw.

With attention to the present arm assembly, the same includes a main arm 5 of tubular construction and having a plug 6 at its proximal end. An axially extending slot 6A in plug 6 corresponds in width and length to a slot 5A in arm 5. Plug 6 is secured by fasteners at 7 extending through apertures in arm 5.

An arm support 8 includes a plate 10 in plug slot 6A. A pivot pin 11 carried by the plate extends through plug 6 and tubular main arm 5 thereabout. Pivot pin 11 is supported by plate 10 centrally disposed on a base 12 having a shaft 13 received in bushing 4 of support 3.

An arm limit stop permits a range of arm movement about the axis of pivot pin 11 and includes an upright slot 14 in plate 11 through which slot extends a stop member 15 the later travel of which is limited by the ends of slot 14. Further, the limit stop means positions the arm assembly at or near horizontal while permitting upward rotation of arm 5 about pivot pin 11. Accordingly the arm 5 may be swung upwardly during tilting of the dental chair, if in the path of chair travel to an upright position for patient egress. Such free movement of the arm avoids damaging loads being imparted to the arm or equipment carried thereby.

A secondary arm 16 is slidably carried in the main arm to enable positioning of a tool holder 17 at the outer end of arm 16. An array of typical dental tools are shown in broken lines at T. A slide bearing at 20 in main arm 5 supports a secondary arm 16. An end fitting 21 on the secondary arm carries tool holder 17.

Guide means are provided to permit rectilinear movement of secondary arm 16 without rotation about its axis. Toward this end followers at 23 project in radial fashion from an inner end segment 16A of the secondary arm. End segments 24 of the followers engage guides 25 formed lengthwise along opposed internal wall surfaces of main arm 5 with follower ends oppositely disposed from their respective guides. The followers may be embodied in pins in frictional engagement with the walls of radially extending bores in inner end segment 16A of arm 16. The pin end segments are preferably machined to provide a radiussed groove 26 which rides along a correspondingly radiussed edge 27 of the guide.

An elastomeric ring at 28 cushions the outward extent of arm travel by contact with slide bearing 20 while a resilient button at 29 contacts plug 6 to cushion the limit of inward travel of arm 16.

While I have shown but one embodiment of the invention, it will be apparent to those skilled in the art that the invention may be embodied still otherwise without departing from the spirit and scope of the invention.

Having thus described the invention, what is desired to be secured by a Letters Patent is.

I claim:

1. A telescopic arm assembly for the adjustable support of dental tools adjacent a dental chair, said arm assembly including, a main arm of tubular construction and defining a slot at its proximal end, an arm support disposed in said slot and including a pivot pin in engagement with said proximal end of the main arm and limit stop means acting on said main arm limiting upward arcuate movement of the main arm about said pivot pin, a secondary arm slidably disposed in said first arm and having at its distal end a dental tool holder, and guide means carried by said first arm and said second arm permitting rectilinear movement of said second arm without rotation of the second arm about its longitudinal axis, said guide means including followers extending from said second arm in a radial manner and rotationally offset from one another about said longitudinal axis, a guide in parallel with and extending lengthwise of the arm assembly and engaged by said followers to constrain the secondary arm for rectilinear travel without arm rotation.

2. The telescopic arm assembly claimed in claim 1 wherein said followers are pins having ends in inserted engagement with the secondary arm and with pin extremities oppositely disposed from said guide.

3. The telescopic arm assembly claimed in claim 1 wherein said arm support includes a plate, said limit stop means comprises a stop member for limited lateral travel in an opening in said plate.

4. A telescopic arm assembly for supporting dental tools including, a main arm of tubular construction, a secondary arm slidably disposed in said main arm and having a distal end for the support of a dental tool holder, an arm support including a plate in inserted engagement with the proximal end of said main arm, a pivot pin carried by said plate and on which the proximal end of said main arm is carried, said plate defining an elongate opening, a stop member carried by said proximal end of the main arm for limited travel in said elongate opening, guide means on said main arm and said secondary arm including pin shaped followers projecting laterally from the secondary arm, guides extending lengthwise along the interior of said main arm, said followers in sliding contact with said guides and restricting the secondary arm against rotation relative the main arm.

* * * * *